United States Patent [19]

Stoll

[11] Patent Number: 4,854,218

[45] Date of Patent: Aug. 8, 1989

[54] PISTON AND CYLINDER UNIT

[76] Inventor: Kurt Stoll, Lenzhalde 72, D-7300 Esslingen, Fed. Rep. of Germany

[21] Appl. No.: 913,984

[22] Filed: Oct. 1, 1986

[30] Foreign Application Priority Data

Oct. 5, 1985 [DE] Fed. Rep. of Germany ..... 3535704

[51] Int. Cl.[4] ..... F15B 11/04; F15B 11/12; F15B 15/28; F15B 15/08

[52] U.S. Cl. ..... 91/1; 91/42; 91/43; 91/361; 92/27; 92/136; 92/165 R

[58] Field of Search ..... 91/1, 43, 358 A, 361, 91/363 R, 42; 92/8, 24, 28, 165 R, 27, 136; 74/89.12; 188/290

[56] References Cited

U.S. PATENT DOCUMENTS

| | | | |
|---|---|---|---|
| 2,016,727 | 10/1935 | Roth | 91/1 X |
| 2,607,548 | 8/1952 | Hollander | 188/290 X |
| 2,851,014 | 9/1958 | Healy | 91/1 |
| 2,988,056 | 6/1961 | Rumsey | 91/363 R X |
| 3,095,785 | 7/1963 | Cahill | 91/43 X |
| 3,691,911 | 9/1972 | Visser | 91/1 X |
| 3,807,284 | 4/1974 | Alexander | 92/8 X |
| 3,898,912 | 8/1975 | Wills | 91/1 |
| 4,339,984 | 7/1982 | Hiihne | 91/43 X |
| 4,380,273 | 4/1983 | Walter | 92/136 X |
| 4,457,210 | 7/1984 | Pauliukonis | 92/136 X |
| 4,614,004 | 9/1986 | Oshida | 188/290 |
| 4,635,901 | 1/1987 | Pond | 91/1 |

FOREIGN PATENT DOCUMENTS

| | | |
|---|---|---|
| 3748611 | 4/1979 | Fed. Rep. of Germany . |
| 3412352 | 9/1985 | Fed. Rep. of Germany . |

*Primary Examiner*—Gerald A. Michalsky
*Attorney, Agent, or Firm*—McGlew & Tuttle

[57] ABSTRACT

The invention relates to a piston and cylinder unit whose piston rod is provided with a rack extending along it. The rack is in mesh with a ring of teeth (such as the teeth of a toothed belt or the teeth of a gear wheel) adapted to revolve about one axis (in the case of a gear wheel) or about at least two axes (in the case of a toothed belt). Such meshing engagement takes place in every position of the piston rod. When the piston rod is moved in the direction of its length the ring of teeth revolves about at least one axis and rotates a means for influencing the motion of the piston rod. Such means may for example be a liquid brake or a synchro transmitter connected with a NC unit controlling the supply of driving fluid to the piston and cylinder unit.

24 Claims, 2 Drawing Sheets

PISTON AND CYLINDER UNIT

BACKGROUND OF THE INVENTION

The invention relates to a piston and cylinder unit and more particularly so such an arrangement of the type comprising a cylinder tube shut off at both its ends by cylinder end caps and a piston running axially in the cylinder tube with a piston rod extending from it in the longitudinal direction of the cylinder tube through at least one of the cylinder end caps so that it may slide therethrough, with a fluid tight sealing effect, for the operation of a load situated outside the cylinder tube.

SUMMARY OF THE INVENTION

One object of the present invention is to provide a piston and cylinder unit of this type having simple and low-cost components for influencing the manner in which the piston and the piston rod are moved.

A more specific objective of the present invention is to devise such a piston and cylinder unit in which such influence is with respect to the speed of displacement of the piston rod and/or the manner in which it is positioned.

In order to achieve these or other objects appearing from the present specification and claims, the piston and cylinder unit is so contrived that the piston rod has a flat rack-like series of teeth thereon, or connected thereto, in order to mesh with a ring of gear teeth able to turn about an axis that is fixed in relation to the cylinder tube, such meshing continuing in every position of the piston rod so that the ring of gear teeth is turned when the piston rod is moved in translation, the ring of teeth being connected with a means for controlling the motion of the piston rod. If the rod joined to the piston rod is acted upon by pneumatic pressure medium such as compressed air on one side of it, the piston rod will be moved in the respective direction and the ring of gear teeth meshing with the rack teeth will revolve about the said axis. Dependent on whether the piston rod is moved into or out of the interior of the cylinder tube, the revolving motion will be clockwise or counterclockwise. The linear displacement of the piston rod is thus transformed into a rotary motion, to which the means for controlling the piston displacement then responds simultaneously. It is then possible to use this controlling means to modify the displacement of the piston rod and thus modify its action on the load: there is for instance then the possibility of constructing the controlling means in the form of a brake so that by braking the rotation of the ring of gear teeth externally of the cylinder tube it is possible to slow down the speed of the piston rod. However there is also the further possibility of using the controlling means to detect the instantaneous position of the piston rod so that it will then be possible at any time to ascertain or monitor the cumulative displacement at a given time and then to operate accessory components in accordance with the total displacement, such accessory components for example effecting a positioning of the piston rod. A particular advantage of the piston and cylinder unit of the invention is that the sensor for the functions to be performed is not the piston rod itself but utilizes the intermediately placed ring of gear teeth. In the present context a rotary movement is substantially simpler to convert and to process than a linear displacement, and it is even possible to arrange the system in keeping with the invention stationarily and directly adjacent to the cylinder tube itself so as to save space, i. e. to provide a compact overall design. Last but not least, the use of a rack and the ring of teeth (which may be the teeth on a toothed belt or on a gear wheel) provides for a secure and reliable transmission of the motion of the piston rod to the device for controlling the piston movement. In such a case a direct transmission would give rise to problems since it would for instance be necessary to make use of wiper contacts or long electrical leads.

Advantageous further developments of the invention will be seen in the claims.

In accordance with further features of the invention the ring of gear teeth may take the form of the teeth on a gear wheel. Alternatively, they may be in the form of teeth on a belt which is mounted on two bend pulleys so that the belt is able to revolve about the axes of the two pulleys. The pulleys may have toothed outer surfaces which mesh with internal teeth of the belt. The rack-like teeth may take the form of a rack directly applied to the piston rod and may, more particularly, be in the form of a rack cut into the surface of the piston rod. Thus the rack and the piston rod may be in the form of a single and integral structure. The form of the teeth on the rack may be such that each tooth is defined by two planar tooth flanks and the edges connecting such two flanks may have a linear extent and be parallel to each other. Such edges may be aligned so as to be transverse in relation to the direction of motion of the said piston rod. More specifically, they may be normal to such direction. These further features of the invention ensure simple tooth designs that may be produced at a low cost and which is reliable in use.

In accordance with a further feature of the invention the rack on the piston rod has a length which, as measured in the length direction of the piston rod, is equal at least to the stroke of the piston. More especially, the design is such that, in one end-of-stroke position of the piston the teeth of the wheel or belt is at one end of the rack teeth and at the other end of the stroke it is located at the other end thereof. This ensures that the gear wheel or gear belt is in engagement with the rack in every position of the piston rod so that there is minimum wear engagement between the two meshing components.

The piston rod may have a rectangular cross section with four longitudinal sides on one of which the rack teeth are arranged so that such longitudinal side has the form of a rack. This constitutes a simple form of the invention in which the piston rod is more or less in the form of a square rod with one of its sides embodying the rack.

It is possible for the axis of turning of a gear wheel, or one of the axes of the turning of the belt, to be arranged so that it is normal to the longitudinal direction of the piston rod. It is further possible to have bearing means for the gear wheel or gear belt shaft directly mounted on the cylinder tube. This bearing means may for instance be mounted on the end cap of the cylinder tube carrying the wheel or belt. The gear wheel may be arranged in the cylinder tube or it may be arranged in a receiving chamber therefor in one of the cylinder end caps, such chamber being open towards the piston rod to allow meshing engagement between the gear wheel, or the gear belt, and the rack or the like on the piston rod. These features make for a compact design of the piston and cylinder arrangement and furthermore the gear wheel is shielded against damage.

The teeth of the gear wheel or the gear belt may be made of material that is relatively soft such as a resinous material or a rubber-like material. This ensures a practically wear-free mesh between the gear wheel or gear belt on the one hand and the rack teeth on the other hand.

The means for controlling the motion of the piston rod may comprise a liquid brake adapted to function as a means for damping motion of the piston rod and the piston thereon by controlling the velocity thereof. In such a system the shaft connected with the gear wheel or the gear belt may be connected with the liquid brake. The liquid brake may comprise a brake member with projections thereon and a liquid vessel surrounding the brake member, for influencing rotation thereof by liquid viscosity opposing it, and accordingly opposing turning turning of the gear wheel or belt so that there is an influence on the speed of the linear motion of the piston rod in the axial direction of the cylinder. The projections on the brake member in the vessel may be in the form of ribs, vanes or paddles. The vessel may be in the form of a container secured to the end cap in which the gear wheel or gear belt is housed so as to allow rotation of the shaft therein, which is supported at its end in the interior of the container and is keyed to the brake member. Such a liquid brake makes it possible to brake the speed of the piston and the piston rod and this means that the piston will not jar against the one or other end cap in the terminal position in the cylinder. In fact, the piston will slowly approach the end cap and softly run up against it.

As a further possible development of the invention the means for controlling the motion of the piston rod comprises a synchro transmitter adapted to respond to the respective angle of turning of the gear wheel or gear belt and the number of turns thereof occurring during displacement of the piston rod. The synchro transmitter may if desired be adapted to give a signal representing the instantaneous position of the piston rod in relation to the cylinder tube or in relation to the initial position of the rod. The use of the synchro transmitter in this respect leads to a substantially more accurate monitoring of the position of the piston rod than would be the case if the monitoring means were to directly respond to the position of the piston rod. It is convenient in this respect if the synchro transmitter is adapted to issue signals that indicate the respective position of the gear wheel and therefore of the piston rod.

The controlling device may comprise a preferably numerical central command processing unit connected with the synchro transmitter in order to process the signals therefrom. The NC processing unit may for this purpose have an indicator for indicating the number of turns completed by the gear wheel or the gear belt or indicating the position of the piston rod as determined on the basis of the number of turns of the gear wheel or gear belt.

The central control unit may include valve means and stroke preselector means, and may be adapted to control motion of the piston within the piston tube by changing the supply and release of driving fluid to and from piston spaces on two sides of the piston with the piston tube and thus moving the piston into a preselected position. The invention may further include a piston stroke arrestor adapted to check motion of the piston in a desired part of its stroke and to release the piston again, such arrestor being adapted to cooperate with the rack on the piston rod. The central control unit may comprise components for positioning the piston rod. It is an advantage if the command unit acts by way of the rod arrestor so that the piston and piston rod are locked in a given position mechanically until they are released again by operation of the arrestor.

The arrestor may comprise an arresting plunger placed at a right angle to a plane in which the rack teeth are arranged, and at a right angle to the longitudinal direction of the cylinder tube. Furthermore there is a guide for the plunger to allow linear motion thereof between two positions, the guide being fixed in relation to the cylinder tube. One of these positions of the plunger is one in which it is disengaged from the rack teeth, and in a second position the plunger engages a part of the rack teeth in order to check translation of the rack. The arrestor plunger may be adapted to be pneumatically operated by being connected with a driving piston. The arrestor may be arranged in the cylinder tube or in the cylinder end cap which accommodates the gear wheel or gear belt, there being a hole in this end cap to act a the guide for the plunger. These further developments of the invention relate to advantageous forms of the arrestor which make the piston and cylinder unit more compact and make it possible for the gear wheel or gear belt to be accommodated in the cylinder end cap.

In order to provide a reliable sealing function on the side of the piston rod with the rack or rack teeth, the gear wheel or the gear belt may be made of a plastic with sealing properties. This ensures a reliable sealing effect despite the presence of the rack teeth on the piston rod, in the zone in which the piston rod extends through the end cap.

It is possible to have a guide member arranged in the cap through which the piston rod extends on a side of the rod opposite to a further side on which the rack teeth are provided, the piston rod engaging the guide member with a running fit. The guide member is secured to the end cap. This guide member serves to take up the pressing force produced by the gear wheel on the rack teeth so that optimum free running of the piston rod is ensured at all times. Furthermore the guide member also takes up any pressure exerted by the arrestor plunger.

It is an advantage if the means for controlling the motion of the piston rod comprises not only a liquid brake but furthermore a synchro transmitter so that the two useful effects of both these means are realized in a single piston and cylinder unit.

If the toothed means driven by the rack is in the form of a gear wheel there is the advantage of a comparative simplicity of manufacture. Since such a gear wheel may be made small in size, the piston and cylinder unit may be made compact.

The ensuing text is devoted to an account of possible specific embodiments of the invention as illustrated in the accompanying drawings.

LIST OF THE FIGURES OF THE DRAWINGS

DETAILED ACCOUNT OF WORKING EXAMPLES OF THE INVENTION

Figure 1:
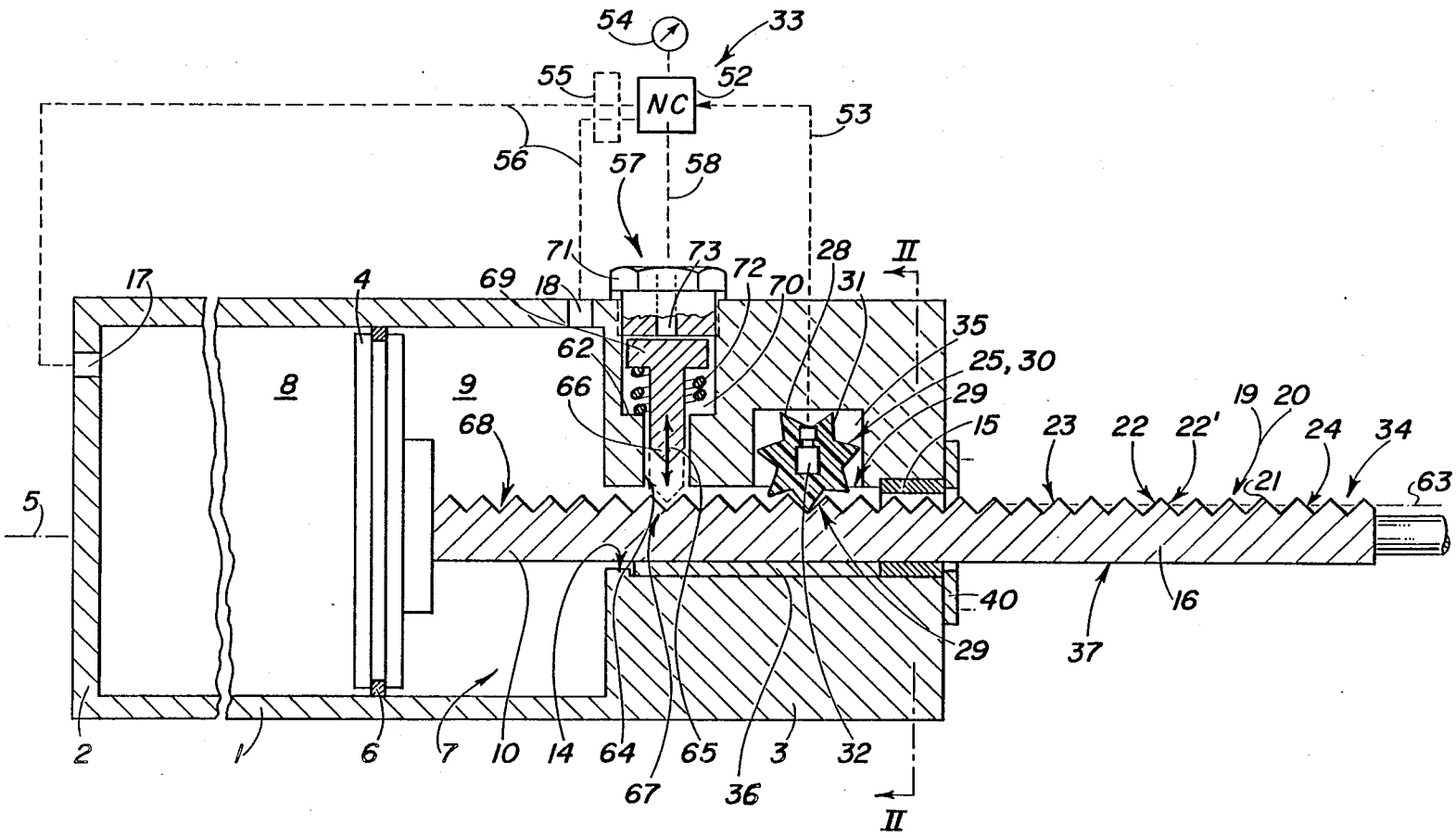
FIG. 1 shows a first possible working example of the invention in the form of a piston and cylinder unit, as seen in longitudinal section.
Figure 2:
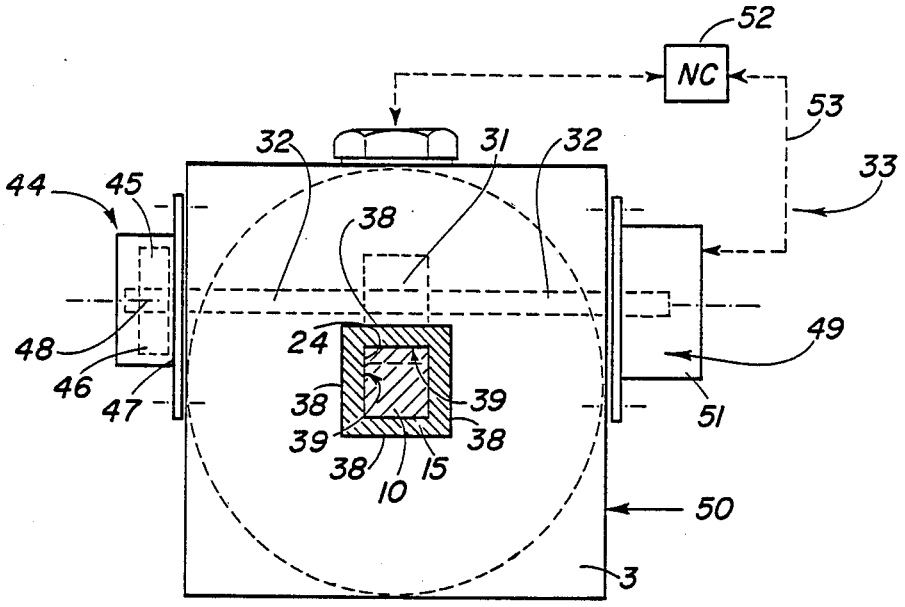
FIG. 2 represents a section of the piston and cylinder unit of FIG. 1 as taken on the line II—II of FIG. 1.

The description is firstly devoted to an embodiment of the piston and cylinder unit as shown in FIGS. 1 and 2. It will be seen that there is a cylinder tube 1, which is shut off at its two ends with respective cylinder end caps 2 and 3. A piston 4 runs within the cylinder tube 1 in its axial direction 5. The piston 4 divides the interior 7 of the cylinder tube 1 into two piston spaces 8 and 9 and it has a piston ring 6 to make a good seal between these two spaces. One end of a piston rod 10 is connected with the piston 4 coaxially. The piston rod 10 extends in the longitudinal direction 5 and extends through one of the cylinder end caps 3, in which it runs in a through opening 14 in the cylinder end cap 3. There is a packing 15 to seal off the piston space 9 adjacent to the cylinder end cap 3 from the outside. The part 16 projecting from the cylinder tube 1 and the cylinder end cap 3 of the piston rod 10 may be connected with a load (not shown), as for instance in the form of the carriage of a machine or the like, so that same may be shifted on operation of the piston and cylinder unit. Furthermore there are ports 17 and 18 leading into the two piston spaces 8 and 9 for the connection with a driving fluid line so that by the supply and/or release of such fluid into and from the interior 7 of the cylinder the piston 4 and the piston rod 10 may be shifted along the cylinder axis.

In accordance with the invention there is a rack 19 on the piston rod 10 so as to extend in the longitudinal direction thereof. These teeth of the rack are best machined directly in the material of the piston rod 10 so as to be integral therewith, or they may be made separately. Whatever the particular case however, the rack teeth are spoken of herein as being secured to or being on the piston rod, irrespectively of whether they are actually an integral part of the rod or not. In the present working example the rack 19 is in fact made up of superficial teeth structures 20 produced by matching the piston rod. The rack teeth 21 extending along the axis 5 of the piston rod are each perpendicular to the longitudinal direction of the piston rod 10. The tooth edges 23 joining two tooth flanks 22 and 22' together have a linear extent and are arranged so as to be parallel to each other. The tooth flanks themselves 22 and 22' may be planar if desired. The rack 19 is thus a linear, flat rack.

As a general teaching of the invention, teeth of the rack may be provided on any standard piston rod and in the working example in keeping with figure 1 the piston rod has a rectangular or square cross section; it is a question of a square piston rod. The teeth of the rack 19 are placed on one longitudinal side (referenced 24) of the piston rod, and the piston rod is accordingly configured as a straight rack. Consequently the passage opening 14 has a suitably adapted cross section so that the piston rod runs therein backwards and forwards without being able to be twisted in relation thereto.

The rack 19 is in engagement with a part 29 of the circumference of a ring 25 of peripheral teeth 30 (here the teeth of a gear wheel, although this is not so in all cases, see below). This gear wheel is coaxially mounted on a shaft 32 which is suitably bearinged in the cylinder end cap 3. The pitch of the peripheral teeth 30 of the gear wheel 31 is so related to the pitch of the rack 19 on the piston rod 10 that the gear wheel 31 meshes with the rack 19 on translation of the piston rod 10 in the axial direction 5 and accordingly the gear wheel is turned about its axis 12 of rotation.

In the present working example of the invention, the ring 25 of teeth on the gear wheel 31 and also the rack 19 on the piston rod 10 are in the form of straight spur teeth so that the tooth edges 28, projecting radially from the shaft 32 of the ring 25 of teeth, are parallel to the teeth edges 23 of the teeth on the rack 19. Consequently the shaft 32 is parallel to these edges 23 and 28 and it is at a right angle to the longitudinal direction 5 of the piston rod.

In the embodiment of FIG. 1 the ring 25 of teeth, that is to say the gear wheel 31, is connected with device 33 for controlling the motion of the piston rod, this device depending for its operation on the rotation of the gear wheel 31. The motion of the piston rod 10 is therefore to be controlled with the aid of the device in the piston and cylinder unit of the present invention, the rotary motion of the gear wheel 31 delivering the input quantity for the control system.

In order to ensure trouble-free operation of the unit it is necessary that for the ring 25 of teeth be in mesh with the rack 19 in every position thereof. For this reason it is appropriate if the length of the rack 19 is at least equal to the maximum stroke length of the piston 4 which is connected to the piston rod 10. The arrangement of the rack 19 along the piston rod 10 is such that in one terminal position of the piston 4 (adjacent to the cylinder end cap 2) the ring 25 of teeth is adjacent to the one axial end part 34 furthest from the piston 4 of the rack 19, whereas in the other terminal position of the piston 4 (adjacent to the cylinder end cap 3) it is preferably adjacent to the opposite end part of the rack 19. In the working example of FIG. 1, however, the piston rod 10 has the rack extending along it, as far as the piston rod 4, to make for simpler manufacture and accordingly the length of the rack is greater than the maximum stroke of the piston 4.

As we have seen the ring 25 of teeth is supported by the shaft 32 in the one cylinder end cap 3 so that it may rotate, and it is arranged in a receiving chamber 35 formed in the interior of the cylinder cap 3. The gear wheel 31 is therefore not visible from the outside, something that tends to make the unit more compact as a whole and to prevent damage to the ring of teeth. As looked at in the length direction 5, the receiving chamber 35 is placed to the side of the passage opening 14 of the piston rod 10 and opens into it so that the passage opening 14 is in direct communication with the receiving chamber 35.

The gear wheel 31 arranged in the chamber 35 is such that at least its part 29, which is in engagement with the rack 19, extends out of the chamber 35 towards the passage opening 14 and extends into same to make meshing contact with the rack 19.

In the case of a further possible working example of the invention, not illustrated, the ring 25 or gear teeth or the gear wheel 32 is placed directly in the interior 7 of the cylinder tube 1, it then naturally being necessary to adopt suitable measures in order to preclude a jarring impact of the piston 4 on the gear wheel. It is obviously also possible to place the ring 25 of gear teeth outside the cylinder tube and the cylinder end caps without impairing the function of the invention.

In the passage opening 14 there is a guide member 36 for the piston rod 10 and the part of the latter opposite to the rack teeth in the passage opening at any given time is supported in it with a running fit. This guide member forms a counter bearing to take up the pressing force exerted by the ring 25 of teeth on the opposite side 24 of the piston rod. The guide member 36 is preferably in the form of a plate and has a rectangular configuration, whose length is somewhat less than the length of the passage opening 14 and whose breadth is approximately the same as the breadth of the piston rod side 37. It is convenient if the piston rod 10 is additionally flanked by respective guide plates, which are preferably made integral with the guide member 36 so that the latter is in the form of a channel. It will be clear that it is also possible to have a bearer member acting on the top of the rack 19 in order to relieve the ring 25 of teeth.

As noted earlier, the piston rod 10 extends through the passage opening 14 with a sealing effect so that the interior of the cylinder 7 is shut off from the outside. The seal used for this purpose in the working example of figure 1 is secured in the cylinder end cap 3, and it is so designed that the piston rod 10 engages a sealing structure on all its sides. To this end the seal 15 is made with an annular shape having a rectangular or square cross section so as to be complementary to the cross section of the piston rod, the sides, facing the piston rod 10, of the four sealing sections 38 of the sealing ring 15 forming the sealing parts 39. The annular seal 15 thus has the piston rod 10 extending through it coaxially, and the axial dimension of the seal 15 is preferably such that the sealing part 39 adjacent to the rack covers at least two teeth 21 of the rack 19 evenly, so than on the one hand there is only a minimum wear while on the other hand there is an optimum sealing effect. The seal 15 is inserted from the outside into the passage opening 14 and is clamped in placed between the guide member 36 and a clamping plate 40 which is detachably screwed onto the end face of the cylinder end cap 3.

In order to enhance the efficiency of the seal 15 adjacent to the rack 19, the ring 25 of teeth and, in the case of the embodiment of FIG. 1, the complete gear wheel 31 is made of a relatively soft plastic or resinous material, such as more especially rubber material which is wear resistant and nevertheless has sealing properties. Since the ring 25 of teeth is in engagement with the rack 19 and preferably is in addition lightly pressed against it, the result is a practically wear-free sealing or packing. In addition, the receiving chamber 35 may be so designed that the gear wheel 31 placed therein has its radial sides in contact with the two side chamber walls with sufficient clearance to give a running fit, and also at least one of the tooth edges 28 of the tooth, that at any given instant is within the receiving chamber rests with a running fit against the chamber wall radially surrounding the gear wheel. In this respect it is a particular advantage that the wall radially opposite to the teeth in the ring 25 is arcuately curved so that the teeth edges 28 which are in the receiving chamber 35 at any instant are able to slide along in contact with this wall.

In the working example of the invention, viewed in FIG. 1, the gear wheel 31 is fitted so that it is able to freely turn in the receiving chamber 35 with a small clearance between it and all the chamber walls so that in this case a labyrinth-like sealing effect is produced. In this respect it is an advantage if the number of gear teeth is made as large as possible.

The following part of the description is concerned with the device 33 for controlling the motion of the piston rod. In the present working example it comprises a liquid brake 44, by way of which the velocity of displacement of the piston 4 and of the piston rod 10 may be reduced and damped. In this respect the shaft 32, carrying the gear wheel 31, extends outwards through the cylinder end cap 3 in a fluid-tight manner and its end part 48 is keyed to a brake member 45, which in this form of the invention has braking vanes 46 extending radially from the shaft 32. The braking member 45 is placed in a brake container 47, screwed onto the side of the cylinder end cap 3, so that it may turn therein. The container 37 is filled with a liquid such a oil.

If the piston rod 10 is now moved in the direction of its length, the braking member 45 will accordingly rotate in the liquid in the brake container 47 so that the translatory motion of the piston rod 10 will be opposed by a braking force. The result of this is a lower piston velocity and a reduced impact force when the piston runs up against the cylinder end caps in its terminal positions, this reducing the strains put on the arrangement as a whole.

The device 33 for controlling the piston motion may in addition to the liquid brake 44, or as alternative thereto, have a synchro transmitter 49 which is connected with the ring 25 of teeth, that is to say with the gear wheel 31. In the present form of the invention, the synchro transmitter 49 is fitted in addition to the liquid brake 44 and it is opposite it on the opposite side 50 of the cylinder end cap. In this respect the shaft 32 extends through the cylinder end cap 3 as far as the side 50 with a sealing effect and is joined to the synchro transmitter 49, which is accommodated in a guide housing 51 detachably screwed on this side 50. The signals from the synchro transmitter will provide an indication of the angular position of the shaft 32, or the number of rotations completed by it since the start of a displacement of the piston rod, so that it is possible to know the instantaneous position of the piston rod and/or the distance moved by it, or in other words the absolute and/or relative positions of the piston rod. The synchro transmitter 49 therefore serves to ascertain the position of the piston rod and/or for determining the distance it has been shifted. The drive of the synchro transmitter is not directly from the piston rod 10 but indirectly by way of the intermediately placed gear wheel 31 keyed on the shaft 32.

In order to process the data from the synchro transmitter 49 and in order to be able to control further components, which are also external, the synchro transmitter 49 is connected electrically via lines 53 with a central processing unit 52, more especially an NC unit.

The NC unit 52 is connected with an indicator unit 54, which gives a continuous visual reading for the instantaneous position of the piston rod or the distance traveled by it and/or the piston speed. In consequence the user is kept constantly informed of the functional condition of the piston and cylinder unit and may take steps to regulate it if necessary.

The NC unit 52 is furthermore available for controlling or operating the valve devices 55, shown schematically, for varying the supply and discharge of fluid under pressure to and from the two piston spaces 8 and 9 in the interior of the cylinder tube 1. The connections between the NC control unit 52 and the ports 17 and 18 are only marked in broken lines and schematically (at 56) for the sake of simplicity.

There is therefore the possibility of changing the supply and discharge of fluid to and from the piston spaces in accordance with the positions of the piston rod or the like so that positioning of the piston rod and of the piston to achieve certain preselected positions becomes a very simple matter. In this connection the NC control unit may be preprogrammed with certain data indicative of the desired positioning of the piston rod. Such data values are then compared with the true values for the piston rod setting, as delivered by the synchro transmitter, and exact positioning becomes possible using a suitable circuit in the NC unit.

In order to halt the piston rod 10 at the desired position aimed at, at least for a short time in which it is locked, there is an arrestor 57 which is able to be operated by the NC unit 52 (via the control line 58 marked as a chained line) and which cooperates with the teeth of the rack 19 on the piston rod 10.

In the present example of the invention the arrestor 57 or latching device possesses an arresting plunger 62 which is set so as to be at a right angle to the plane 63 containing the rack 19 and which is opposite to the rack 19. This plunger runs in a guide hole 64 machined in the cylinder end cap 3 so that it may move in the direction of its length (arrow 65) and it may more especially be moved between two terminal or end positions. In the first of these end positions, the release position, the arrestor plunger 62 has its end part 66, which is further from the rack 19, out of engagement with the same so that the rack may be shifted without anything opposing it. In the second position of the arrestor (marked in broken lines in FIG. 1) the plunger 62 has its end part 66 in engagement with a part 67 of the rack 19 and accordingly firmly latches the piston rod 10. It is convenient if the end part 66 has a form which is complementary to the spaces 68 between the teeth of the rack 19 so that in its latching condition the end part 66 fits snugly in between two adjacent teeth of the rack.

For operation the arrestor plunger 62 has a drive piston on its end opposite to the end part 66. This drive piston 69 runs in a widened part 70 of the guide hole 64 so that it may move in the longitudinal direction. This widened part 70 opens to the outer side of the cylinder end cap 3 but normally it is shut off by a detachable plug 71 which has a hole 73 through it whose one end leads into the guide hole 64 and whose other end is in communication with the line 58.

Under the control of the NC unit 52 it is possible for the drive piston 69 to be supplied with fluid under pressure, more especially compressed air, so that it is forced into its latching position. On the other hand if the line is vented, then the arrestor plunger 62 will be moved by the force of a return spring 72, mounted in the guide hole, back into its non-latching or release setting. (Another arrangement in accordance with the invention, not shown, would be possible in which the arrestor plunger would be moved by fluid under pressure in both directions rather than being operated by a spring in one of the directions).

In the present form of the invention the arrestor 57 is accommodated in the one cylinder end cap which also houses the ring 26 or teeth or gear wheel 31, in the interests of overall compactness. However it would also be possible for the arrestor to be located in the interior of the cylinder tube or outside the cylinder tube and the cylinder end caps.

Figure 3:
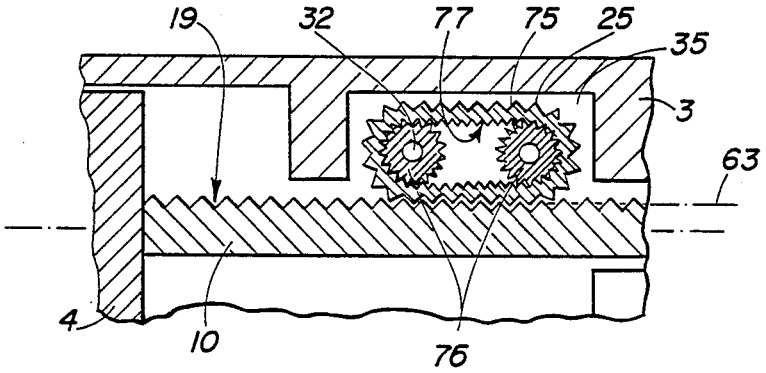
FIG. 3 is a section of part of a further embodiment of the piston and cylinder device of the invention to show a modified form of the toothed means engaging the rack teeth.

In the case of a further embodiment of the invention as viewed in section in FIG. 3 in part only, the ring 25 of teeth is on a toothed belt 75 which runs on two bend pulleys 76 of the same diameter and having parallel axes which are in a plane parallel to the plane 63 containing the rack 63. The ring 25 of teeth is on the side of the belt facing away from the pulleys 76. It is convenient if the inside of the toothed belt 75 is provided with internal teeth 77 to engage teeth on the pulleys so that there is positive engagement at all times.

In the case of the working example of the innovation shown in FIG. 3, the rack 75 and the bend pulleys 76 are also housed in a chamber in the cylinder end cap 3, in which respect however the one shaft 32 of the one pulley has to extend out of the end cap in order to provide a connection with the synchro transmitter and/or the liquid brake.

It is furthermore to be noted that in all the possible examples of the invention the ring of teeth is best made of a soft material, as for example urethane resin, whereas the rack 19 is hard and is more particularly made of metal.

I claim:

1. In a piston and cylinder unit having a cylinder body comprising a tube with end caps; a piston mounted for controlled axial displacement in the tube; a piston rod extending along part of the tube with a portion of the piston rod mounted to extend through one end cap externally of the body in sealing engagement with the one end cap for axial movement relative thereto with an external end of the portion free for coupling to a power take-off; a rack having a toothed portion extending along the portion of the piston rod from a location external of the body through the one end cap into said tube part; and, a pinion gear in operative engagement with the toothed portion of the rack throughout the working stroke of the piston rod, piston rod movement control means connected with the pinion gear means to connect a supply of pressure fluid to said part of the tube, the pinion gear being mounted inside the cylinder body with the pinion gear in operative engagement with a toothed portion of the rack inside the cylinder body.

2. A piston and cylinder unit as claimed in claim 1 in which the pinion gear comprises a toothed belt mounted for rotation around two guide pulleys.

3. A piston and cylinder unit as claimed in claim 1 in which the rack and the piston rod are formed integrally in one piece.

4. A piston and cylinder unit as claimed in claim 3 in which the teeth have planar flanks.

5. A piston and cylinder unit as claimed in claim 4 in which intersections of adjacent flanks each extend linearly and the intersections are in mutually parallel relation.

6. A piston and cylinder unit as claimed in claim 1 in which the toothed portion of the rack is of equal length to the working stroke of the piston so that the pinion engages the respective opposite ends of the toothed portion of the rack at respective opposite ends of the piston stroke.

7. A piston and cylinder unit as claimed in claim 1 in which a chamber having an opening adjacent the piston rod is provided in the one end cap and the wheel of the pinion gear is located in the chamber extending through the opening into engagement with the toothed portion of the rack.

8. A piston and cylinder unit as claimed in claim 1 in which the wheel of the pinion gear consists of material which is soft relative to the rack material for sealing engagement with the rack teeth.

9. A piston and cylinder unit as claimed in claim 1 including a fluid brake arranged to dampen the speed of the piston.

10. A piston and cylinder unit as claimed in claim 9 in which the fluid brake comprises a rotary brake body provided with rotary friction surfaces immersed in a fluid bath, the brake body being fixed to a rotary axle of the pinion gear so that rotation thereof produces rotation of the friction surfaces thereby reducing the speed of the piston during the working stroke.

11. A piston and cylinder unit as claimed in claim 10 in which the pinion gear is mounted in the one end cap and the fluid brake has a brake housing located on the exterior of the said one end cap, the rotary brake body and the pinion gear being mounted together for rotation on a common axle which extends through the end cap in a sealing fit therewith.

12. A piston and cylinder unit as claimed in claim 1 in which the piston rod displacement is controlled by a tachogenerator linked with a numerically operated processing unit for controlling supplementary equipment.

13. A piston and cylinder unit as claimed in claim 12 in which the processing unit is connected with a display unit showing the position of the piston rod during the working stroke, detected by the rotation of the pinion gear.

14. A piston and cylinder unit as claimed in claim 13 in which the processing unit is operatively connected to actuating valves controlling the supply of pressure fluid to respective opposite sides of the piston thereby to enable the processing unit to set the piston rod in preselected positions.

15. A piston and cylinder unit as claimed in claim 1 in which an arresting device is mounted in a guide bore extending through the cylinder body and is connected to the processing unit for operation thereby into and out from engagement with the rack thereby to fix the piston rod in selected longitudinal positions.

16. A piston and cylinder unit as claimed in claim 15 in which the arresting device comprises a catch mounted in the bore for reciprocal movement perpendicularly of the rack into and out from engagement with the toothed portion of the rack.

17. A piston and cylinder unit as claimed in claim 16 in which the arresting device is connected for actuation to a pneumatically operated position.

18. A piston and cylinder unit as claim 12 further comprising a fluid brake arranged to dampen the speed of the piston the pinion gear being connected simultaneously with the fluid brake and the tachogenerator.

19. A piston and cylinder unit as claimed in claim 1 in which the sealing engagement is provided by sealing means mounted in the one end cap in sliding engagement with the entire transverse periphery of the portion of the piston rod passing therethrough.

20. A piston and cylinder unit as claimed in claim 19 in which the toothed portion of the rack extends along one side of the piston rod, the pinion gear consists, at least partially, of synthetic material having sealing properties and is arranged to seal, at least partially the one side of the piston rod by engagement with the rack teeth.

21. A piston and cylinder unit as claimed in claim 1 in which a guide body of channel section is fixed in the one end cap, the piston rod being received as a sliding fit in the guide body with the rack located adjacent the channel mouth.

22. A piston and cylinder unit according to claim 1 in which the wheel of the pinion gear is mounted in the one end cap and consists of material which is soft relative to the rack material for sealing engagement therewith.

23. A piston and cylinder unit having a cylinder body comprising a tube with end caps; a piston rod mounted for controlled axial displacement in the tube; the piston rod extending longitudinally of the tube with a portion of the piston mounted to extend through one end cap externally of the body for axial movement relative thereto with an external end of the portion free for coupling to a power take-off; a rack extending along one side of the portion of the piston rod through the one end cap; a chamber formed in the one end cap and having an opening adjacent the piston rod; a pinion gear rotatably mounted in the chamber with a pinion wheel extending through the opening into operative engagement with the rack; a device connected to the pinion gear for controlling the piston rod movement; a channel section guide surface provided in the one end cap and receiving the portion of the piston rod as a sliding fit with the rack located adjacent the channel mouth, the pinion wheel being elastomeric and cooperating with wall surfaces of the chamber to provide a labyrinth seal on the one side of the piston rod by engagement with the rack; and, a sealing annulus of complementary cross-section to the piston portion, which annulus is mounted in the one cylinder end cap between the chamber and the exterior with the said portion of the piston passing through the sealing annulus which forms a sliding, sealing fit with all sides thereof.

24. A piston and cylinder unit having a cylinder body comprising a tube with end caps; a piston rod mounted for controlled axial displacement in the tube; the piston rod extending longitudinally of the tube with a portion of the piston mounted to extend through one end cap externally of the body for axial movement relative thereto with an external end of the portion free for coupling to a power take-off; a rack extending along one side of the portion of the piston rod through the one end cap; means to connect a supply of pressure fluid to a part of the tube; a chamber formed in the one end cap and having an opening adjacent the piston rod; a pinion gear rotatably mounted in the chamber with a pinion wheel extending through the opening into operative engagement with the rack; a device connected to the pinion gear for controlling the piston rod movement; a guide channel provided in the one end cap extending between the chamber opening and said part of the tube and receiving the portion of the piston rod as a sliding fit with the rack located adjacent the channel mouth.

* * * * *